United States Patent [19]

Ikebuchi et al.

[11] Patent Number: 4,660,776

[45] Date of Patent: Apr. 28, 1987

[54] VERTICAL GRINDING MILL

[75] Inventors: Iwao Ikebuchi, Hirakata; Kazuo Fuse, Nara; Akira Ganse, Tokyo, all of Japan

[73] Assignee: Kubota Ltd., Osaka, Japan

[21] Appl. No.: 786,547

[22] Filed: Oct. 11, 1985

[51] Int. Cl.[4] ..... B02C 17/16

[52] U.S. Cl. ..... 241/53; 241/58; 241/172

[58] Field of Search ..... 241/171, 172, 48, 52, 241/58, 53, 179, 175, 57

[56] References Cited

FOREIGN PATENT DOCUMENTS 888641 9/1953 Fed. Rep. of Germany ..... 241/172

2110336 9/1972 Fed. Rep. of Germany ..... 241/172

594294 2/1978 U.S.S.R. ..... 241/172

OTHER PUBLICATIONS

International Application, WO 85/02559, 6-1985.

*Primary Examiner*—Mark Rosenbaum

*Attorney, Agent, or Firm*—Wenderoth, Lind & Ponack

[57] ABSTRACT

An improved vertical grinding mill is provided which has a shell, a vertical helically bladed shaft rotatably mounted in the shell, a collector, a drive for the shaft, and a fan or a pump. The shaft is hollow and its lower end is open at the bottom of the shell. This assures a uniform distribution of the material to be treated, the grinding medium and the product particles and thus high production efficiency.

1 Claim, 7 Drawing Figures

VERTICAL GRINDING MILL

The present invention relates to a vertical grinding mill used to pulverize emery, alumina, etc. into fine or ultrafine particles by grinding.

A conventional grinding mill of this type is shown in FIG. 7. A vertical helical bladed shaft 2 is rotatably mounted in a vertical shell 1. Grinding medium b such as steel balls is fed into the shell. While rotating the shaft, the materiaL a to be pulverized is fed into the shell. The material is pulverized to fine particles by friction between the material and the grinding medium. The fine product particles c are carried by an air current out of the shell and collected by means of a collector 3 such as a bag filter and a cyclone. The air current formed by a fan 4 is introduced through an intake nozzle 5 into the bottom of the shell 1 and leaves the shell at its top with the fine particles. Since the air current is blown into the shell from one side of its bottom, the product particles will be unevenly distributed as shown in FIG. 7 with a dotted line, and thus will not be smoothly discharged out of the shell. Therefore, the production efficiency is relatively low and the capacity was small for a large apparatus size.

An object of the present invention is to provide a vertical grinding mill which obviates the abovesaid shortcomings, and which has a high production efficiency.

In accordance with the present invention, there is provided a vertical grinding mill which comprises a shell for containing the material to be pulverized and grinding medium, a vertical helical bladed shaft rotatably mounted in the shell so as to extend through a top wall of the shell for agitating the material and the grinding medium to pulverize the material to fine particles, means for driving the shaft, collector means for collecting the fine particles, and means for forming a fluid current to take the fine particles out of the shell and pass them through the collector means, characterised in that the shaft is hollow and has its bottom end open at the bottom of the shell.

Other features and objects of the present invention will become apparent from the following description taken with reference to the accompanying drawings, in which.

The same or similar reference numbers are employed to designate the same or similar parts.

Figure 1:
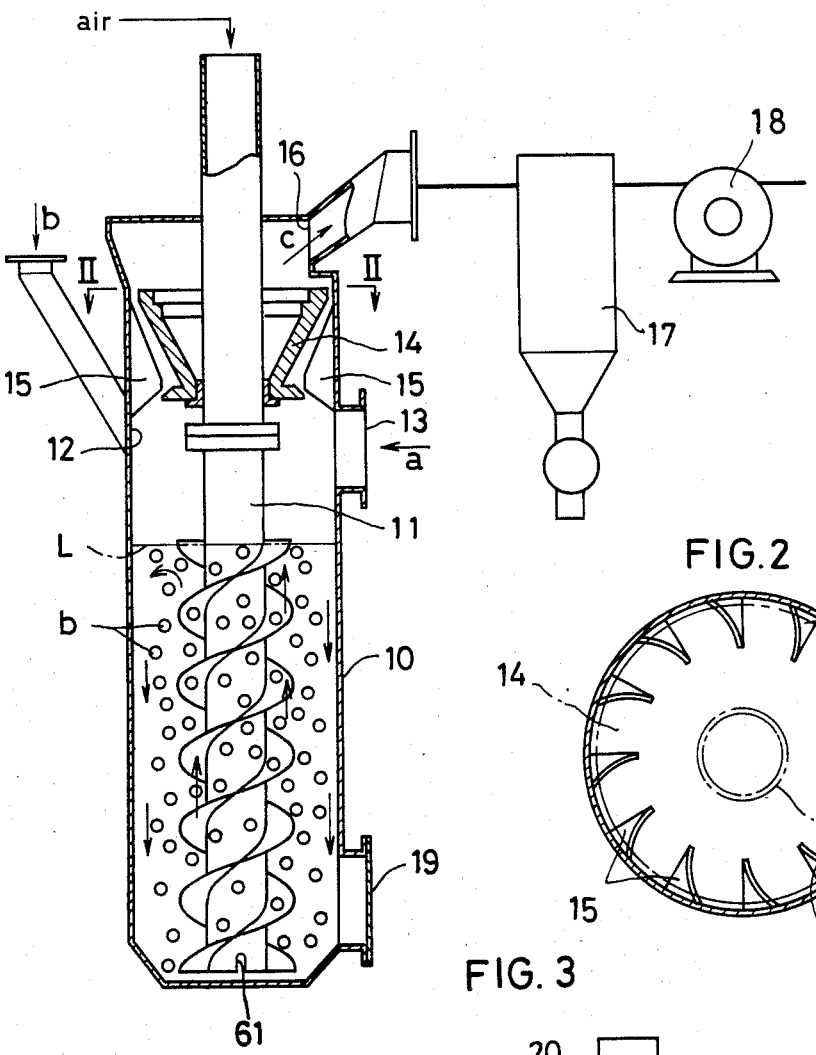
FIG. 1 is a partially sectional schematic view of the first embodiment.

Referring to FIG. 1 illustrating the first embodiment, a vertical grinding mill comprises a vertical cylindrical shell 10 having its top and bottom walls closed, and a helical bladed shaft 11 turnably supported in the center of the cylindrical shell 10 by means of thrust and radial bearings (not shown). The shaft extends through the top wall of the shell 10 and is rotated by drive means (not shown). The shaft 11 is hollow and has its upper end connected to a source of air and its lower end open near the bottom of the shell 10. Because the inside of the shell is under negative pressure, air flows through the screw shaft 11 into the shell 10 from its bottom.

The shell 10 is provided at its upper portion with an inlet 12 for the grinding medium b and an inlet 13 for the material to be pulverized. Through the inlet 12, the grinding medium such as ceramic, gravel or steel balls is fed until the shell is filled up to the level L in FIG. 1. Through the inlet 13, the material to be pulverized is fed into the shell 10 by a screw conveyor or the like, keeping airtightness. As the shaft 11 rotates, the grinding medium and the material to be pulverized are moved in the direction of arrows and agitated. As a result, the material is pulverized to fine particles c by friction between the material and the grinding medium.

Figure 2:
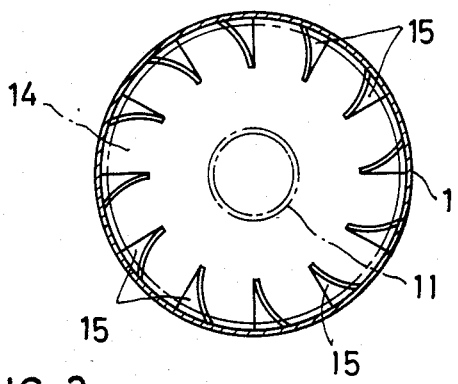
FIG. 2 is a sectional view taken along the line II—II of FIG. 1.

At the upper portion of the shell 10, a conical classifying member 14 is mounted on the shaft 11. As shown in FIG. 2, blades 15 are provided at regular intervals on the inner wall of the shell 10 so as to be opposed to the classifying member 14. The blades 15 are curved toward the direction of rotation. Above the classifying member 14, is formed a suction port 16 to which a suction fan 18 is connected through a product collector 17 such as a bag filter and a cyclone. This fan 18 puts the inside of the shell 10 under negative pressure, so that air will flow into the shaft 11 from its top.

In order to obtain particles of a desired size or assure a smooth operation, the apparatus should be operated on the basis of the result of measurement of such parameters as the level of the material in the shell, the speed of air flow in the shell, the particle size of the product, etc. The level of the material may be detected either by means of a level indicator or by measuring the difference between pressure at the suction port 16 and pressure at top of the shaft 11. The speed of air flow may be measured at top of the shaft 11 by use of an orifice or a Venturi tube. The level of the material in the shell may be controlled by adjusting the amount of material supplied, and the speed of air flow may be controlled by adjusting the r.p.m. of the fan. An outlet 19 is provided to take the grinding medium out of the shell.

In operation, when the shaft 11 starts to rotate and the material to be pulverized is fed into the shell, the shaft will agitate the material and the grinding medium, so that the material will be pulverized to fine particles by friction between them. On the other hand, when the suction fan 18 is started, air will flow through the shaft 11 downwardly into the bottom of the shell 10 and spread uniformly in all directions. This air current will flow up in the shell 10, swirling up between the classifying member 14 and the blades 15. The air current passing therebetween carries up the fine particles, which pass through the suction port 16 and are collected in the collector 17. The coarse particles are separated when passing between the blades 15 and the classifying member 14.

Since the air from the bottom of the shaft 11 spreads uniformly in all directions and disperses the grinding medium and the material to be pulverized, they will not stay at the same position. Since the suction from the fan 18 puts the inside of the shell 10 under a negative pressure, the requirement for sealing to avoid pollution of the work environment is not so severe and the operation is easy to control.

Also, because the flow rate through the suction port 16 can be easily controlled by adjusting the suction fan 18, particles having a uniform particle size can be obtained.

Figure 3:
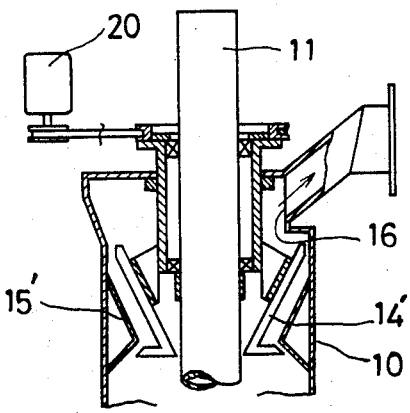
FIG. 3 is a partially sectional view showing another example of the classifying member.

FIG. 3 shows another example of the classifying member 14' which comprises a vane wheel rotatably mounted on the shaft 11 and adapted to be rotated by a motor 20. An annular member 15' triangular in cross section may be formed on the inner wall of the shell 10. The provision of the members 15' makes easy the formation of swirling air flow. But, the classifying members 14, 14' and the blades 15 and the triangular members 15' may be omitted. Even if they are omitted, coarse particles will drop by their own weight without being sucked through the suction port 16.

Figure 4:
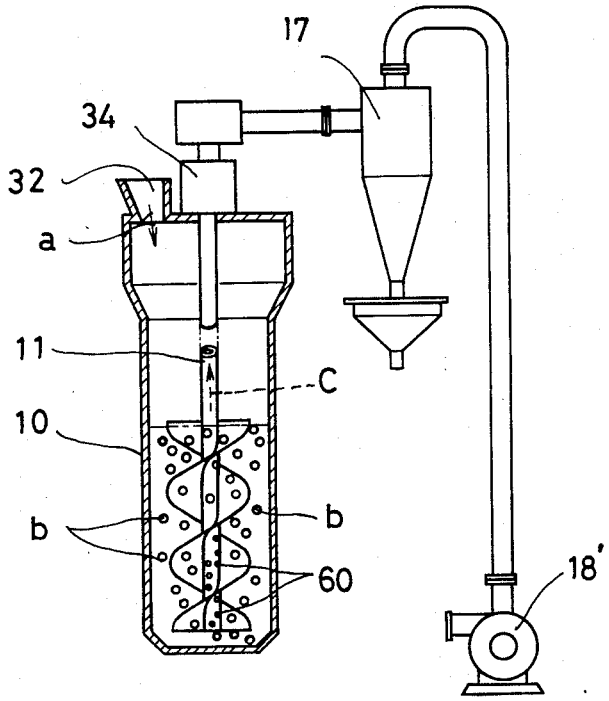
FIGS. 4–6 are partially sectional schematic views of the second to fourth embodiments.

Referring to FIG. 4 showing the second embodiment, which is a vertical grinding mill of a wet type, a hollow helical bladed shaft 11 is mounted in the center of a cylindrical shell 10 as in the first embodiment. The shaft is supported by means of a support means 34 such as thrust and radial bearings so as to extend through the upper wall of the shell 10. It is driven by drive means (not shown) and has its bottom end open at the bottom of the shell.

The shell is provided at its top with an inlet 32 through which both the material a to be pulverized and the grinding medium b are fed into the shell 10. The top of the shaft 11 is connected to a pump 18' through a product collector 17. Suction from the pump 18' puts the inside of the shell 10 under a negative pressure. This causes water or chemical liquid to flow through the inlet 32 into the shell 10, down to its bottom, up through the shaft 11 to the product collector 17. The material to be pulverized may be fed with water in the form of slurry.

In operation, firstly the shaft 11 is driven and the pump 18' is started to form the current of fluid. When the material to be pulverized is fed, it is pulverized to fine particles by friction between the material and the grinding medium. The product particles c are carried by the abovesaid current through the shaft 11 upwardly and are collected by the product collector 17.

As in the first embodiment, since the inside of the shell is under negative pressure, the requirement for sealing is not severe and control of the operation is easy.

Figure 5:
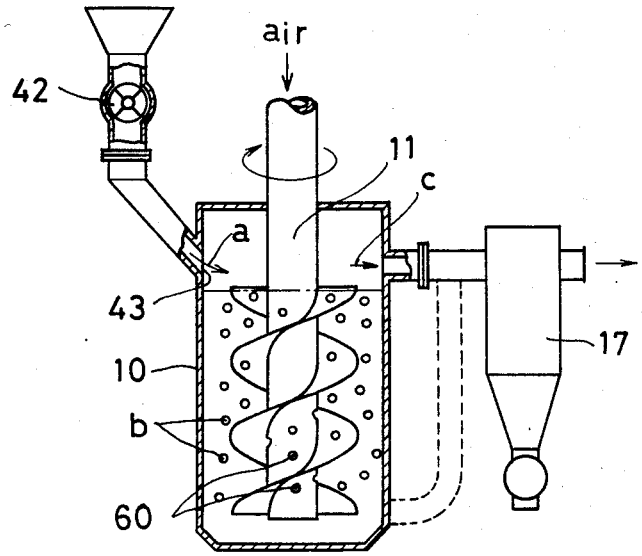

Next, referring to FIG. 5 showing the third embodiment, a hollow helical bladed shaft 11 is rotatably supported in the center of a shell 10, as in the other embodiments. The shaft 11 has its upper end connected to the discharge side of a fan (not shown) and its lower end open at the bottom of the shell 10.

The material a to be pulverized and the grinding medium b are fed through a rotary valve 42 and an inlet 43 into the shell, keeping airtightness. To the top of the shell is connected a product collector 17. A major difference from the first embodiment is that air is blown into the shell 10 from top of the shaft, whereas in the first embodiment air is sucked into the shell because its inside is under negative pressure.

In operation, after the shaft 11 has started to rotate and an air current flowing down through the screw shaft and up the shell 10 to the collector 17 has been formed, the material to be pulverized is fed. The material is pulverized to fine particles, which go up in the shell 10, carried by the abovesaid current, and are collected by the product collector 17.

The air current from the open bottom of the shaft 11 spreads uniformly in all directions, dispersing the grinding medium and the material to be pulverized without allowing them to stay at the same position. The product particles smoothly go up in the shell over the whole periphery in the shell.

In this embodiment, as shown by dotted lines, the collector 17 may be connected to the bottom of the shell 10 to take the product particles therefrom.

Figure 6:
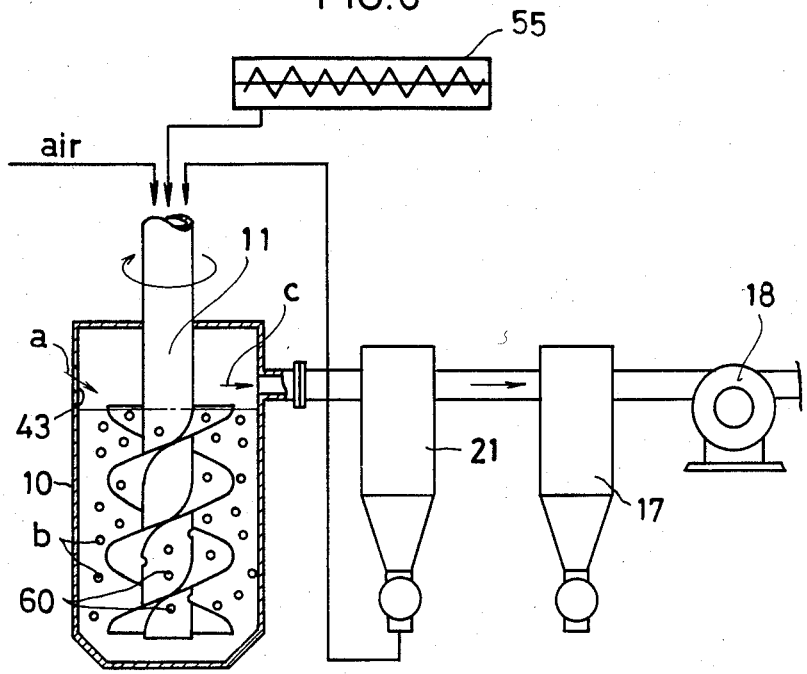
Figure 7:
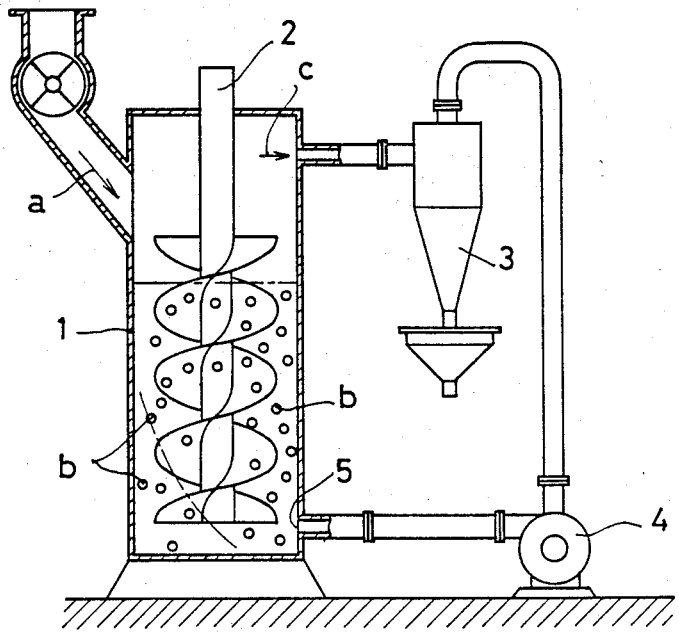
FIG. 7 PRIOR ART
FIG. 7 is a similar view of a prior art apparatus.

Next, referring to FIG. 6 showing the fourth embodiment, the helically bladed shaft 11 is rotatable supported in the shell 10 by means of a thrust bearing and radial bearings (not shown). It is rotated by drive means (not shown) and is open at its bottom end.

To the top of the shaft 11, a material feeder 55 is connected airtightly to feed the material to be pulverized from the bottom of the shaft 11 into the shell 10. To the top of the shell, the suction side of a fan 18 is connected through a classifier 21 and a collector 17. The operation of the fan forms an air current flowing into the shaft 11 into the shell 10 through the classifier 21 and collector 17 to the fan.

In operation, the shaft 11 is firstly rotated and the abovementioned air current is formed. In this state, the material to be pulverized is fed from the material feeder 55 through the screw shaft 11 into the shell 10. The material will be uniformly fed into the shell from the bottom of the shaft 11 and be pulverized to minute particles by friction with the grinding medium. The fine particles are carried upwardly by the air current formed by the fan and are classified by the classifier 21 and the product collector 17. The coarse particles classified by the classifier 21 are fed back to the shell 10 through the shaft 11.

In the second to forth embodiments, the shaft 11 may be formed at its lower portion with a plurality of small holes 60 through which air, the product particles and the material to be pulverized can pass. In the first embodiment, slits 61 are formed at bottom of the shaft 11 instead of the small holes 60.

Although in the first, third and fourth embodiments air is used, dry hot air may be used instead. In this case, dry product particles can be obtained.

Although the classifying member 14 is provided on the shaft in only the first embodiment, it may be provided in any of the other embodiments.

Although all the embodiments except the second one are of a dry type, they can be converted to a vertical grinding mill of a wet type such as the second one by replacing the fan with a pump.

What we claim:

1. A dry vertical grinding mill comprising:

a shell for containing material to be pulverized and grinding medium;

a vertical helically bladed hollow shaft rotatably mounted in said shell and extending through the top wall of said shell and having the bottom end open to the bottom portion of the interior of said shell and the upper part in communication with a source of gas;

means connected to said shaft for driving said shaft in a direction for moving the material and the grinding medium upwardly in the shell to agitate the material and pulverize the material to fine particles whereby a portion of the mixture of grinding medium and material to be pulverized is left under a reduced pressure of the mixture at the bottom of said shell;

collector means at the top of said shell for collecting the fine particles, said shell being otherwise substantially gas tight; and means for forming a gas current having a suction side connected through said collector means to the top of said shell for drawing gas from the source of gas downwardly through said shaft and laterally from the open bottom end of said shaft into said reduced pressure portion of the mixture at the bottom of said shell and then upwardly in said shell to said collector means for taking the fine particles out of the shell and passing them through said collector means.

* * * * *